US006315431B1

(12) United States Patent
Greedy

(10) Patent No.: US 6,315,431 B1
(45) Date of Patent: Nov. 13, 2001

(54) PULL CHAIN WITH LIGHT

(76) Inventor: Christopher Greedy, 150 Westfall Trail, Liberty Hill, TX (US) 78642

( * ) Notice: Subject to any disclaimer, the term of this patent is extended or adjusted under 35 U.S.C. 154(b) by 0 days.

(21) Appl. No.: 09/575,618

(22) Filed: May 22, 2000

Related U.S. Application Data

(60) Provisional application No. 60/151,373, filed on Aug. 30, 1999.

(51) Int. Cl.[7] ..... F21N 131/00

(52) U.S. Cl. ..... 362/253; 362/96; 362/802; 362/205; 362/458

(58) Field of Search ..... 362/458, 96, 253, 362/802, 202, 205

(56) References Cited

U.S. PATENT DOCUMENTS

| | | | | |
|---|---|---|---|---|
| D. 375,244 | | 11/1996 | Merino | D8/310 |
| 1,966,737 | * | 7/1934 | Schmitt | 362/253 X |
| 2,014,217 | | 9/1935 | Williamson | 240/123 |
| 2,924,905 | * | 2/1960 | Seigle | 362/802 X |
| 2,947,105 | * | 8/1960 | Lagios | 362/802 X |
| 5,072,341 | | 12/1991 | Huang | 362/96 |
| 5,497,307 | * | 3/1996 | Bae et al. | 362/802 X |

* cited by examiner

*Primary Examiner*—Laura K. Tso
(74) *Attorney, Agent, or Firm*—Richard C. Litman

(57) ABSTRACT

A pull chain light assembly that attaches to a pull chain for the lamp portion of a ceiling fan. The pull chain light assembly is actuated by a light sensitive switch that turns on a light emitting diode when the amount of light in a room falls below a predetermined level. The pull chain light assembly employs a long lasting lithium battery as its power source.

16 Claims, 3 Drawing Sheets

PULL CHAIN WITH LIGHT

CROSS-REFERENCE TO RELATED APPLICATION

This application claims the benefit of U.S. Provisional Patent Application Ser. No. 60/151,373, filed Aug. 30, 1999.

BACKGROUND OF THE INVENTION

1. Field of the Invention

The present invention relates generally to pull chain actuating switches and more particularly, to a lit pull chain assembly used to provide sufficient light to enable a person to locate a pull chain switch in a dark room.

2. Description of the Related Art

Fumbling through a dark room trying to locate a light switch to turn on a light in the room can be disconcerting and even dangerous, if a person should trip or stumble over something in the room. Having a source of light already on in a dark room that helps guide a person safely to a light switch in the room is clearly advantageous. Pull chain switches are commonly used switches, however, the pull chains are not easy to locate in the dark. Typically, a person is forced to feel around in the dark hoping to locate the pull chain switch.

Ceiling fans employ pull chain electric switches to start or stop the fan and many ceiling fans come with centrally disposed lights that also utilize pull chain switches to turn the lights on or off. Because the pull chain switches are located on the ceiling fan unit itself, a person must enter an unlit room and awkwardly feel around in the dark hoping to locate the ceiling fan's pull chain switch. This is a potentially hazardous situation because a person could easily trip or stumble across unseen objects in the dark room, causing serious bodily injury.

Both pull chain electric switches and ceiling fans with ancillary lights are well known in the prior art, for example, an electric switch actuating mechanism that employs a pull chain is described in U.S. Pat. No. 2,014,217, issued on Sep. 10, 1935 to W. Williamson, whereby a flexible pull chain is connected to a disk that imparts an even pull to the pull chain when the pull chain is used to turn a lamp on or off. U.S. Des. Pat. No. 375,244, issued on Nov. 5, 1996 to D. Merino, describes an ornamental design for a pull chain device. U.S. Pat. No. 5,072,341, issued on Dec. 10, 1991 to M. Huang, describes a lamp assembly suspended from a ceiling fan. The lamp assembly is equipped with several reflection lamp shields which do not affect the illuminating effect of the lamp assembly when they are turned upward.

None of the above inventions and patents, taken either singly or in combination, is seen to describe the instant invention as claimed.

SUMMARY OF THE INVENTION

Accordingly, it is a principal object of the invention to provide a decorative pull chain light assembly that generates sufficient light to be easily identifiable under low light or dark conditions.

It is another object of the invention to provide a pull chain light assembly that is long lasting, that has low power consumption, and that is fully automatic.

It is a further object of the invention to provide a pull chain light assembly that is decorative.

Still another object of the invention is to provide a pull chain light assembly that is inexpensive to manufacture.

It is an object of the invention to provide improved elements and arrangements thereof in a pull chain light assembly for the purposes described which is inexpensive, dependable and fully effective in accomplishing its intended purposes.

The foregoing objectives are achieved in accordance with the present invention by providing a decorative pull chain light assembly comprising a long life lithium battery, a light emitting diode, and a light activated switch installed in a cartridge approximately ½" in diameter and 1½" in length. The pull chain light assembly of the present invention conveniently attaches to a pull chain electric switch making the pull chain switch readily identifiable in low light or dark conditions.

The pull chain light assembly of the present invention has an innovative design that employs a light emitting diode (LED) instead of a bulb and a light sensitive switch. An LED consumes less power and lasts longer than a bulb and provides sufficient light to be readily seen under low light or dark conditions. The light sensitive switch automatically turns on the pull chain light assembly when the amount of light in a room falls below a predetermined level.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
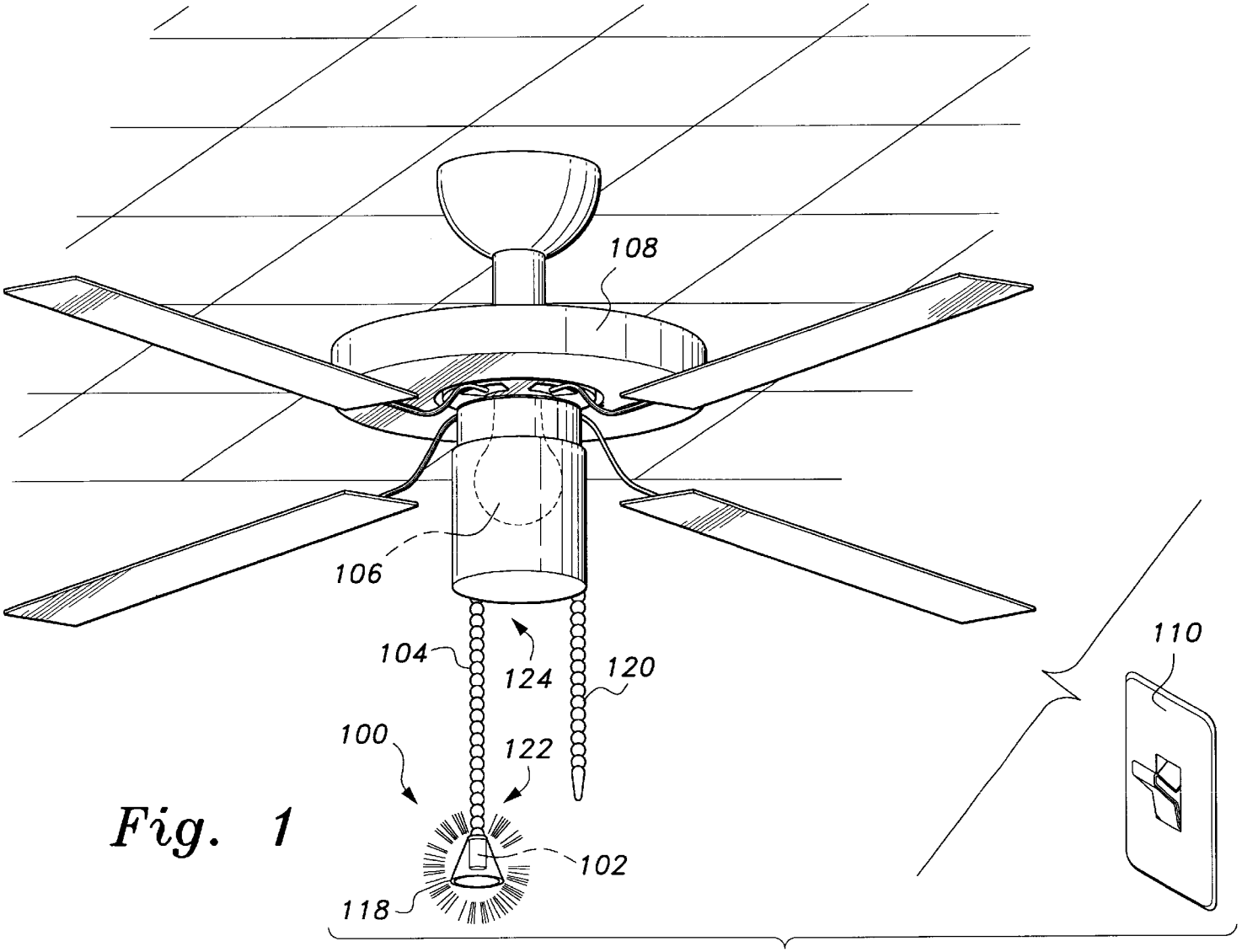
FIG. 1 is an environmental, perspective view of a pull chain light assembly attached to a pull chain for the lamp portion of a ceiling fan according to the present invention.

FIG. 1 shows an environmental, perspective view of a pull chain light assembly 100 attached to the free end 122 of a pull chain 104 for the lamp portion 106 of a ceiling fan 108. The pull chain light assembly 100 of the present invention has a battery power source 112, a light emitting diode (LED) 114, and a light sensitive switch 116 that are housed within either a transparent or a translucent cylindrical cartridge 102. The electrical circuit 126 is either disposed on a printed circuit board (not shown) or the circuit elements 112,114,116 of the circuit 126 are interconnected by separate pieces of electrical wire 128. However, any suitable method of electrical interconnection can be used. The cylindrical cartridge 102 is situated inside either a transparent or a translucent decorative enclosure 118 that serves as a handle 118 for the pull chain 104. The electrical circuit 126 is secured within the cylindrical cartridge 102 using any suitable method of attachment.

The cylindrical cartridge 102 and the decorative enclosure are preferably transparent or translucent so that the light emitted by the light emitting diode 114 may be seen and so that the level of ambient light in the room is readily detected by the light sensitive switch 116. In a preferred embodiment, the cylindrical cartridge 102 and the decorative enclosure 118 are made of either glass or plastic, the battery power source 112 is a long life lithium battery 112 and the cylindrical cartridge 102 is approximately ½" in diameter and 1½" in length. However, any type of long lasting battery 112 with the appropriate dimensions to fit comfortably inside the cylindrical housing 102 can be used as the power source.

The pull chain light assembly 100 uses any of the wide variety of light emitting diodes 114 commercially available or any custom designed LED 114 developed to have enhanced performance characteristics. The circuit 126 may include a resistor for reducing the current to the LED 114. The light actuated switch 116 is a light sensitive solid state switching device. Commercially available light sensitive solid state switching devices 116 and custom designed solid state switching devices exhibit a broad range of performance characteristics and the underlying principles of operation of the different solid state switching devices 116 vary.

When light or photons are present, the light activated switch (or light sensitive solid state switching device) 116 effectively functions as an open switch. In the absence of light, the light sensitive solid state switching device 116 effectively functions as a closed switch. The activation threshold levels of the solid state switching device 116 varies. Therefore, the sensitivity of the pull chain light assembly 100 is varied by using a cartridge containing a solid state switching device 116 with a different activation threshold level.

The pull chain light assembly 100 of the present invention makes it possible for a person to readily identify the location of a pull chain switch 104 within a poorly lit or dark room. The pull chain light assembly 100 is attached to the free end 122 of the pull chain 104 for the light kit or lamp portion 106 of a ceiling fan 108 as depicted in FIG. 1. The pull chain light assembly 100 is attached to the free end 122 of a pull chain 104 using any conventionally known method and the affixed or opposite end 124 of the pull chain switch 104 can be attached to any mechanism, device, or apparatus that utilizes pull chain switches 104, for example, lamps, window shades, and attic stairs.

The pull chain light assembly 100 of the present invention makes it easy to find the pull chain switch 104 of a ceiling fan 108 that is located within a dark room. In a preferred embodiment, the ceiling fan 108 is controlled by a wall switch 110 that is left in the "on" position as depicted in FIG. 1. The light kit portion 106 of the ceiling fan and the ceiling fan itself 108 are turned on and off using their respective pull chain switches (104,120). When the light kit portion 106 of the ceiling fan 108 is off and a room in which the ceiling fan 108 is located is dark, the pull chain light assembly 100 is lit making it very easy to find the pull chain switch 104 for the ceiling fan light 106.

Figure 2:
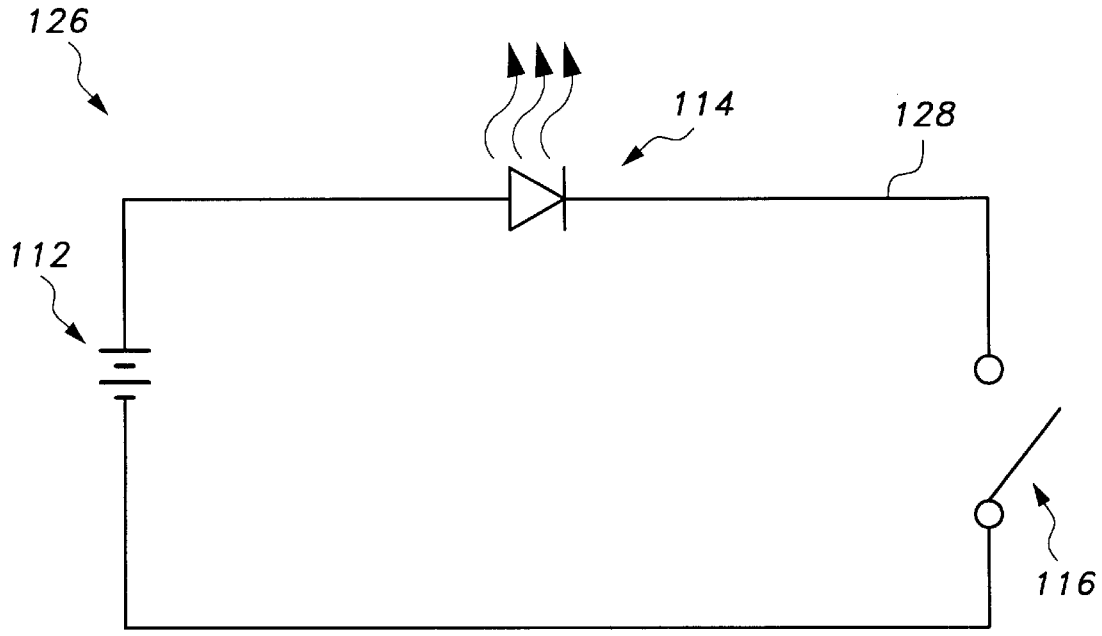
FIG. 2 is an electrical circuit schematic for the pull chain light assembly.
Figure 3:
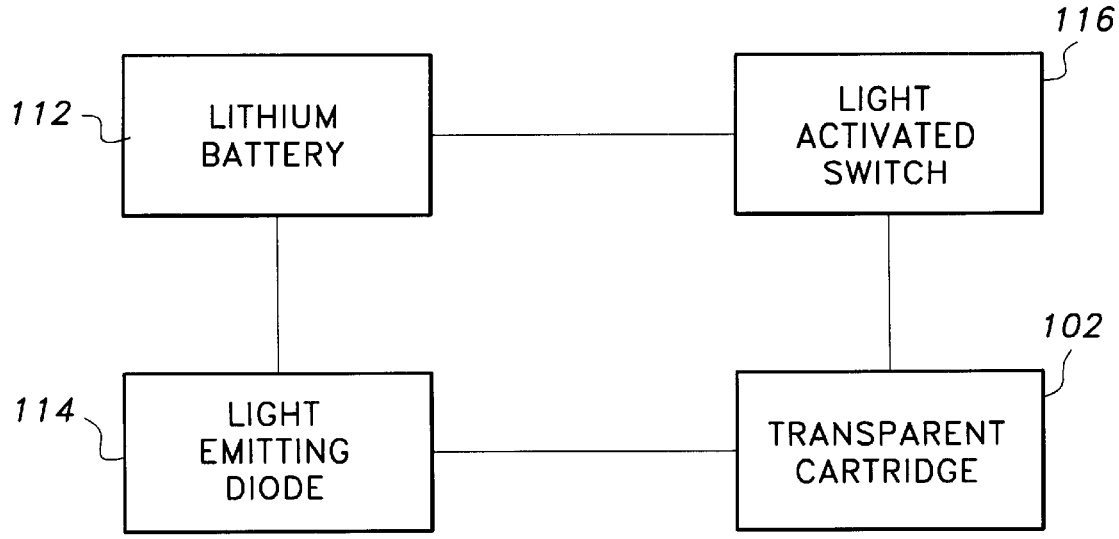
FIG. 3 is a block diagram showing the component parts of the pull chain light assembly.

FIG. 2 is an electrical circuit schematic for the pull chain light assembly 100 showing how the electrical components of the pull chain light assembly 100 are interconnected. The light activated switch 116 is in an open position until insufficient ambient light causes the light sensitive switch 116 to close which causes a current to flow through the circuit and visible light to be emitted by the LED 114. FIG. 3 is a block diagram showing the component parts of the pull chain light assembly 100.

Figure 4:
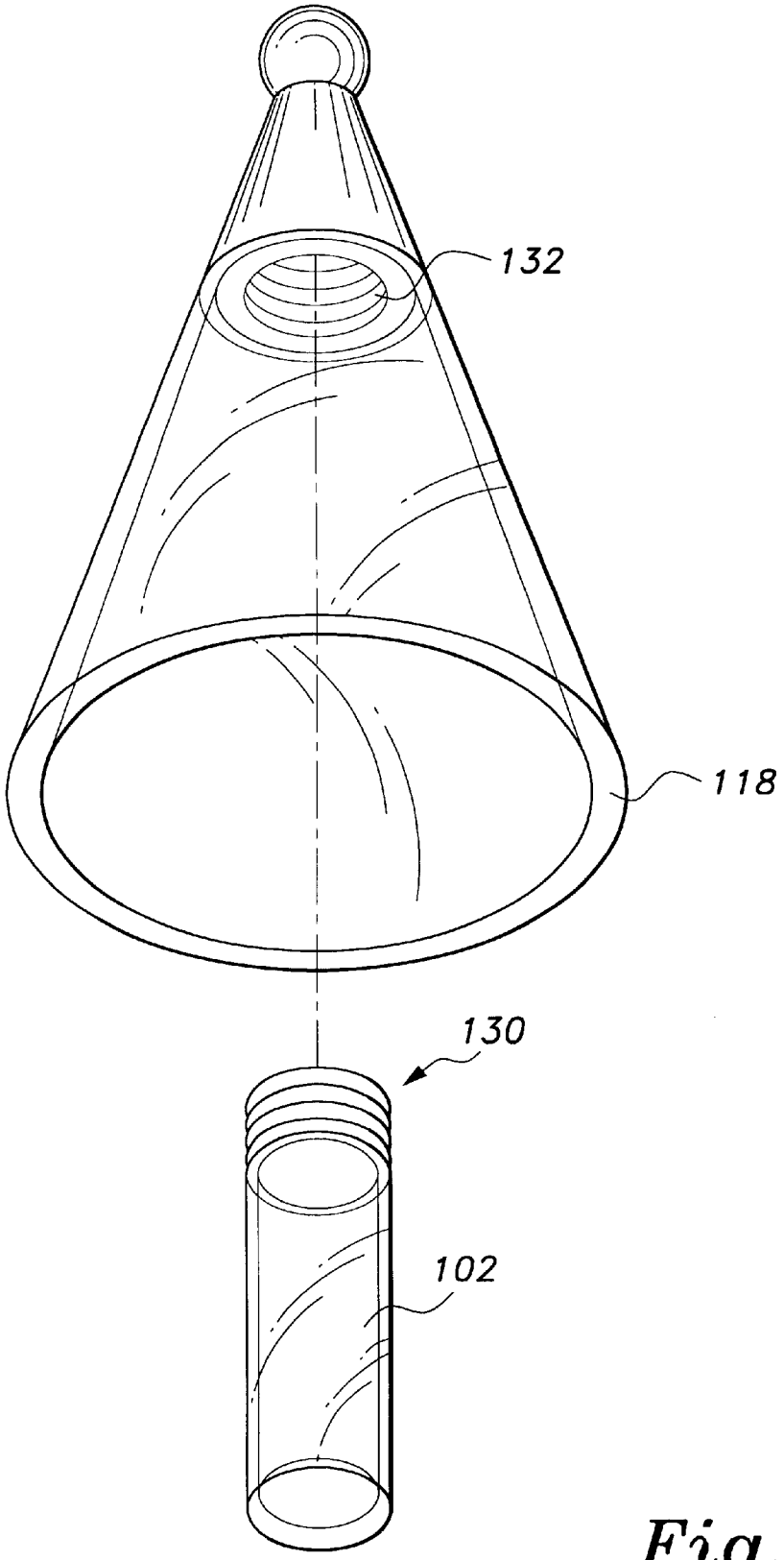
FIG. 4 is an exploded view of the decorative enclosure showing how the cylindrically shaped cartridge fits into the decorative enclosure.

FIG. 4 is an exploded view of the decorative enclosure 118 showing how the cylindrically shaped cartridge 102 containing the visible light generating electrical circuit 126 fits into the decorative enclosure 118. The cartridge 102 can be secured inside the decorative enclosure 118 using any suitable attachment means or mechanism, for example, an adhesive material can be used to hold the cartridge 102 in place or the cartridge 102 can be an integral part of the enclosure 118. In the embodiment depicted in FIG. 4, one end 130 of the cylindrical cartridge 102 is threaded and screws into a threaded receptacle 132 inside the enclosure 118. The threaded end 130 of the cartridge 102 and the threaded receptacle portion 132 of the enclosure 118 can be made of any suitable material, for example, glass, a plastic, or a metal. Interchangeable cartridges 102 allow the user to change the color of light displayed and to replace cartridges 102 whenever necessary. In an alternate embodiment, a non-decorative transparent or translucent enclosure 118 is used as the handle 118 of the pull chain switch 104.

The pull chain light assembly of the present invention with its novel and innovative design makes it easy for a person to find the pull chain switch for a ceiling fan light in a dark room or under other low or dim light conditions. The pull chain switch of the present invention has enormous versatility because it is well-suited for a wide variety of applications. Any situation or circumstance requiring a pull chain actuating mechanism would find the addition of the pull chain lighting assembly extremely beneficial. The pull chain light assembly turns on automatically when the ambient light inside a room falls below a preset level.

The pull chain light assembly generates light by using a light emitting diode, therefore, there are no bulbs to burn out. The numerous advantages of the pull chain light assembly of the present invention include minimum power consumption, miniaturization, and low manufacturing costs.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiments described above, but encompasses any and all embodiments within the scope of the following claims.

I claim:

1. A pull chain light assembly comprising:

a power source;

a light sensitive switch electrically connected to said power source;

a light generating means for generating light electrically connected in series with said switch and said power source; and a housing, said power source, said switch and said light generating means being disposed in said housing, said housing being adapted for attachment to a pull chain.

2. The pull chain light assembly according to claim 1, wherein said power source is a battery.

3. The pull chain light assembly according to claim 1, wherein said light generating means is a light emitting diode.

4. The pull chain light assembly according to claim 1, wherein said switch is a solid state device.

5. The pull chain light assembly according to claim 1, wherein said housing is a cylindrical cartridge.

6. The pull chain light assembly according to claim 5, wherein said cylindrical cartridge is transparent.

7. The pull chain light assembly according to claim 5, wherein said cylindrical cartridge is translucent.

8. The pull chain light assembly according to claim 1, wherein said power source is a lithium battery.

9. The pull chain light assembly according to claim 1, wherein said housing comprises a cylindrical cartridge approximately ½" in diameter and 1½" in length.

10. A light assembly in combination with a pull chain switch comprising:

a decorative enclosure at an end of the pull chain switch;

a light assembly attached to the pull chain switch, said light assembly including:

a lithium battery;

a light emitting diode;

a light sensitive switch; and a cylindrical cartridge;

said lithium battery, said light emitting diode, and said light sensitive switch being housed inside said cylindrical cartridge, said cartridge being disposed within said decorative enclosure.

11. A light assembly according to claim 10, wherein said light sensitive switch is a light sensitive solid state switching device.

12. A light assembly according to claim 10, wherein said cylindrical cartridge is transparent.

13. A light assembly according to claim 10, wherein said cylindrical cartridge is translucent.

14. A light assembly according to claim 10, wherein said cylindrical cartridge is approximately ½" in diameter and 1½" in length.

15. A light assembly in combination with a pull chain switch comprising:

a pull chain switch having a free end;

a transparent enclosure attached to the free end of the pull chain switch;

a transparent cylindrical cartridge disposed within said transparent enclosure; and a visible light generating electrical circuit housed in said transparent cylindrical cartridge.

16. A light assembly according to claim 15, wherein said cylindrical cartridge is approximately ½" in diameter and 1½" in length.

* * * * *